United States Patent [19]

Gosis

[11] Patent Number: 4,780,991

[45] Date of Patent: Nov. 1, 1988

[54] MASK AND PRESSURE BLOCK FOR ULTRA THIN WORK PIECES

[75] Inventor: Anatoly Gosis, Chicago, Ill.

[73] Assignee: General Signal, Stamford, Conn.

[21] Appl. No.: 899,151

[22] Filed: Aug. 22, 1986

[51] Int. Cl.[4] ..... B24B 37/04

[52] U.S. Cl. ..... 51/131.3; 51/283 R

[58] Field of Search ..... 51/131.3, 131.2, 131.1, 51/277, 283 R, 216 LP

[56] References Cited

U.S. PATENT DOCUMENTS

| | | | |
|---|---|---|---|
| 2,842,906 | 7/1958 | Carter et al. | 51/131.2 |
| 3,570,188 | 3/1971 | Ebner | 51/131.2 |
| 4,519,168 | 5/1985 | Cesna | 51/131.3 |

FOREIGN PATENT DOCUMENTS

| | | | |
|---|---|---|---|
| 0052297 | 4/1977 | Japan | 51/131.3 |
| 0065071 | 5/1980 | Japan | 51/131.3 |
| 0157472 | 12/1980 | Japan | 51/131.3 |
| 0196161 | 11/1984 | Japan | 51/216 LP |

*Primary Examiner*—Frederick R. Schmidt
*Assistant Examiner*—Robert A. Rose

[57] ABSTRACT

A mask for use in conjunction with a lapping platen for working an ultra thin work piece with the mask formed to provide circumferentially arranged open receptive areas corresponding to the configuration of the work piece together with a pressure block of identical configuration to the receptacle openings and the work piece for maintaining the same in a controlled flatness upon the rotating lapping platen of a lapping machine.

5 Claims, 1 Drawing Sheet

MASK AND PRESSURE BLOCK FOR ULTRA THIN WORK PIECES

BACKGROUND OF THE INVENTION

Advance technology requires the lapping of ultra thin work pieces. In the past these work pieces have been adhered to a pressure pad either by wax or some other adhering fluid so that the same may be then secured upon the underside of a pressure pad and moved therewith into a working position upon a rotating lapping platen. These methods do not provide uniform substrates and therefore the work pieces copy the imperfections of the adhesive. Furthermore the adhesives present problems for removal of the work piece, resulting in chipping and breaking.

However, as the thickness of the work piece has become increasingly thin, such practice has not been successful in maintaining the work piece in position upon the lapping surface of the lapping platen, nor have they been successful in preventing the ultra thin work piece from creating waves, warps or bulges within their body perameters during the rotational movement necessary for the lapping operation.

OBJECT OF THE INVENTION

It is an object of this invention to provide a system for lapping ultra thin work pieces without the necessity of providing a removable attachment means between the work piece and a pressure pad. This invention provides for a mask to be preformed so as to provide open receptacles, corresponding in shape to the work piece, together with a pressure block of identical configuration to the work piece and the open receptacle, for maintaining the work piece in proper confrontation with the rotating lapping platen.

The mask and pressure block of this invention are adapted to cooperate with a pressure pad which fits conveniently within the circular conditioning ring with the pressure pad having a mechanical stop arrangement whereby the downward pressure is limited or controlled so that the amount of pressure transmitted from the pad to the individual work piece pressure block is regulated. A spring plunger also is carried by the pressure pad and it will engage and maintain the mask upon the lapping surface of the lapping platen and prevent vertical vibration common in lapping operation.

BRIEF DESCRIPTION OF THE DRAWINGS

The invention will be best understood by reference to the accompanying drawing showing the preferred form of construction of the mask and pressure block arrangement by which the stated objects of the invention are achieved and in which.

GENERAL DESCRIPTION

The invention hereinafter described is adapted to be employed with a lapping machine that provides a circular rotatable lapping platen 10. Adapted to be positioned upon the lapping surface of the platen 10 is a conditioning ring 11.

Within this ring 11 is positioned a work piece mask 12 having a diameter substanially equal to the inner diameter of the conditioning rings 11.

Figure 1:
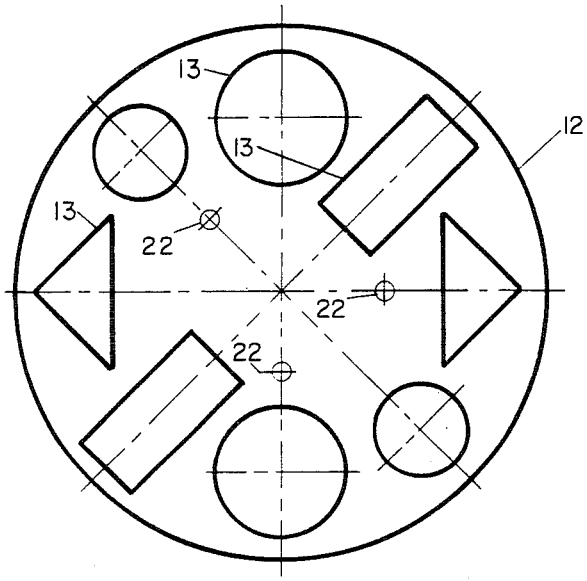
FIG. 1 is a plan view of the mask as employed in this invention showing a plurality of varying configurated open work piece receptacles, formed therein.

As shown in FIG. 1, the mask 12 can be formed so as to provide a plurality of open receptacles 13 which will be designed to conform to the configuration of the work piece to be worked. FIG. 1 shows that the mask is adapted to accept work pieces of varying configurations without departing from the spirit of this invention.

Figure 2:
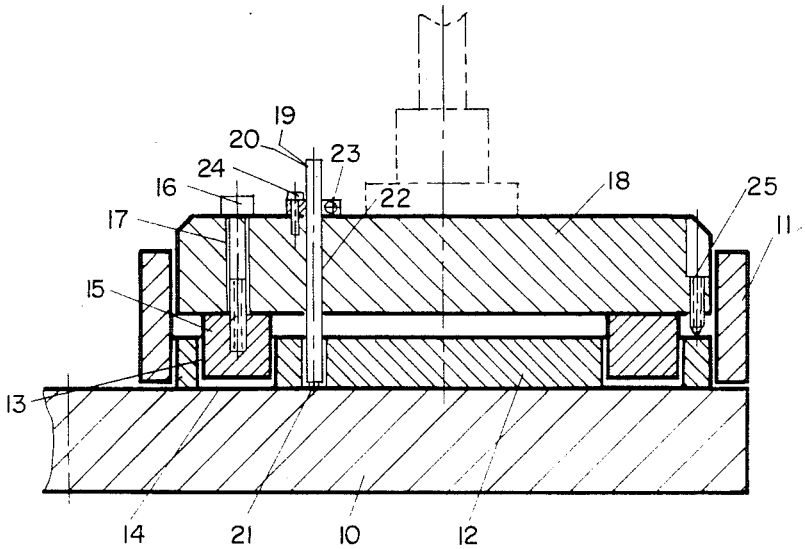
FIG. 2 is a fragmentary detailed sectional view showing the full arrangement of the mask and pressure block of this invention.

As shown in FIG. 2 a work piece 14 is positioned within the open receptacle 13 of the mask 12, and is held in facial abutment with the lapping surface of the platen 10 by a pressure block 15. This pressure block 15 is of an identical configuration so as to mate not only with the open receptacle 13 but with the work piece 14. This pressure block 15 is connected by a threaded bolt 16 that passes through a suitable opening 17 formed in a circular pressure pad 18. The pressure pad 18 has a diameter equal to that of the mask 12 so as to be freely received within the conditioning ring 11.

The pressure pad 18 is adapted to be suspended above the lapping platen 10 and moved vertically with respect thereto into and out of an operative position. The operating position is that shown in FIG. 2, wherein the pressure pad 18 is positioned within the conditioning ring 11. To regulate the positioning of the pressure pad 18 relative to the lapping platen 10 and the resulting positioning of the pressure block 15 upon the work piece 14, there is provided a mechanical stop member 19. This mechanical stop 19 consists of an elongated circular pin 20 having at its one end a diamond tip 21 which will engage the lapping surface of the platen 10 and be resistant to wear. This pin 20 is slideably positioned within a bore 22 formed through the pressure pad 18 as shown in FIG. 2. At the top surface of the pressure pad 18 there is an adjustable clamp 23 mounted by a bolt 24 by which the positioning of the pin 20 may be regulated. For positioning of the pad 18, there are at least three such stop members 19 diametrically arranged about the pad 18.

The pressure pad 18 is also provided with a passage 25 in which there is a spring plunger 26, the exposed end of which is adapted to have yieldable arrangement with the top surface of the mask 12 adjacent its periphery. This spring plunger 26 will hold the mask 12 upon the lapping surface of the platen 10 during lapping operation. Again for complete uniform contact pressure of the mask 12 upon the lapping surface of the platen 10, there are at least three plungers 26 diametrically arranged on the pad 18.

From the foregoing I have described a device that is highly efficient in the lapping of ultra thin work pieces. In the past such ultra thin work pieces were incapable of being held in a controlled flat condition during the lapping operation. The prior reliance upon an oversized pressure pad for contacting and overlying only the upper surface of the work piece prevented the work piece from warping, buckling and crimping during lapping operations, thus producing imperfect wafers.

In utilizating a mask having work receiving openings that correspond to the identical configuration of the work piece, I provide support for the external edges of the work piece. Then applying a pressure block having the same size and/or configuration of the work piece and the mask opening, I provide full facial surface pressure upon the work piece and thus producing a device that is highly efficient in use and economical to manufacture.

While I have illustrated and described the preferred form of construction for carrying my invention into effect, this is capable of variation and modification without departing from the spirit of the invention. I therefore, do not wich to be limited to the precise details of construction as set forth, but desire to avail myself of such variation and modifications as come within the scope of the appended claims.

What I claim as new and novel and desire to protect by Letters Patent is:

1. A fixture for a lapping machine for finishing ultra thin workpieces, with the machine providing a circular rotatable platen, the exposed lapping surface of which supports a truing ring including, (a) a mask positioned in facial contact upon the lapping surface of the platen and providing a plurality of work receiving openings within its periphery, (b) a pressure pad of substantially the same configuration as said mask and overlying said mask when it is positioned upon the lapping surface of the platen, (c) a pressure block carried by said pressure pad having the same configuration as said work receiving openings so as to be positioned therein, with said block having a thickness greater than said mask so as to space said pad from said mask when in overlying position with respect thereto, (d) means connecting said pressure block to said pressure pad so as to be held within said work receiving openings provided by said mask when said pressure pad overlies said mask, and (e) a spring plunger depending from said pressure pad and having one end in contact with the upper surface of said mask when said pressure pad overlies said mask for yieldably maintaining said mask upon the lapping surface of the platen during rotation thereof.

2. A fixture for a lapping machine as defined by claim 1 wherein said means connecting said pressure block to said pressure pad comprises a bolt extending through said pressure pad and threadable into said block to attach said block to the underside of said pressure pad so as to be projected into said work receiving openings provided in said mask when said pressure pad overlies said mask.

3. A fixture for a lapping machine for finishing ultra thin workpieces, with the machine providing a circular rotatable platen, the exposed lapping surface of which support a workpiece holder including, (a) a mask positioned in facial contact upon the lapping surface of the platen and providing a plurality of work receiving openings within its periphery, (b) a pressure pad of substantially the same configuration of and overlying said mask when said mask is positioned upon the platen, (c) a pressure block carried by said pressure pad and having the same configuration as said work receiving openings so as to be positioned therein, with said block having a thickness greater than said mask so as to space said pressure pad from said mask when in overlying position with respect thereto, (d) a bolt extending through said pressure pad and threadable into said block to attach the same to the underside of said pressure pad so as to be projected into said work receiving openings provided in said mask when said pressure pad overlies said mask, and (e) means carried by said pressure pad and extending therefrom in the direction of the spaced mask and having one end in contact therewith for yieldably maintaining said mask upon the lapping surface of the platen when said pressure pad overlies said mask during rotation of the platen.

4. A fixture for a lapping machine for finishing ultra thin workpieces with the machine providing a circular rotatable platen, the exposed lapping surface of which supports a truing ring including;

(a) a mask adapted to be positioned within the turing ring and upon the lapping surface of the platen with said mask having formed therein a plurality of open receptacles, (b) a work piece of the same configuration as said open receptacles and positioned therein in facial contact with the lapping surface of the platen, (c) a pressure block of the same configuration as said open receptacles and said workpiece, (d) a pressure pad within the truing ring removably supporting said pressure block within said open receptacles, (e) means connecting said pressure block to said pressure pad, and (f) a spring plunger depending from said pressure pad and having a free end in contact with the upper surface of said mask when said pressure pad overlies said mask for yieldably maintaining said mask upon the lapping surface of the platen.

5. A fixture for a lapping machine for finishing ultra thin workpieces as defined by claim 4 wherein said means connecting said pressure block to said pressure pad comprises a bolt extending through said pressure pad and threadable into said block to attach said block to the underside of said pressure pad so as to project said block into said work receiving openings formed in said mask when said pressure pad overlies said mask.

* * * * *